United States Patent [19]

Wirt

[11] 3,998,277

[45] Dec. 21, 1976

[54] BULLDOZER ASSEMBLY WITH MEANS FOR PIVOTALLY CONNECTING THE PUSH ARMS THEREOF

[75] Inventor: Leon A. Wirt, Joliet, Ill.

[73] Assignee: Caterpillar Tractor Co., Peoria, Ill.

[22] Filed: Oct. 30, 1975

[21] Appl. No.: 627,314

[52] U.S. Cl. ..... 172/804

[51] Int. Cl.[2] ..... E02F 3/76

[58] Field of Search ..... 172/801, 803, 804, 805, 172/806, 807, 809

[56] References Cited

UNITED STATES PATENTS

| | | | |
|---|---|---|---|
| 2,927,388 | 3/1960 | Skromme et al. | 172/804 |
| 3,049,821 | 8/1962 | Lichti | 172/803 |
| 3,337,974 | 8/1967 | Fisher | 172/807 |
| 3,395,764 | 8/1968 | Wirt | 172/803 |
| 3,590,929 | 7/1971 | Wirt | 172/803 |
| 3,653,451 | 4/1972 | Fryrear et al. | 172/804 |

*Primary Examiner*—Richard T. Stouffer
*Attorney, Agent, or Firm*—Phillips, Moore, Weissenberger, Lempio & Strabala

[57] ABSTRACT

A bulldozer assembly comprises a pair of laterally spaced push arms pivotally mounted at their forward ends to a blade. A stabilizing member is secured to each of the push arms and the members are disposed rearwardly of the blade in disconnected relationship therewith. The inboard ends of the stabilizing members are pivotally connected together by a transverse pivot pin disposed one-half the distance between the ends of the push arms. In a first embodiment, the pivot pin is confined within the stabilizing members whereas in a second embodiment the pivot pin extends completely through the stabilizing members and into the push arms.

11 Claims, 9 Drawing Figures

Fig. 4.
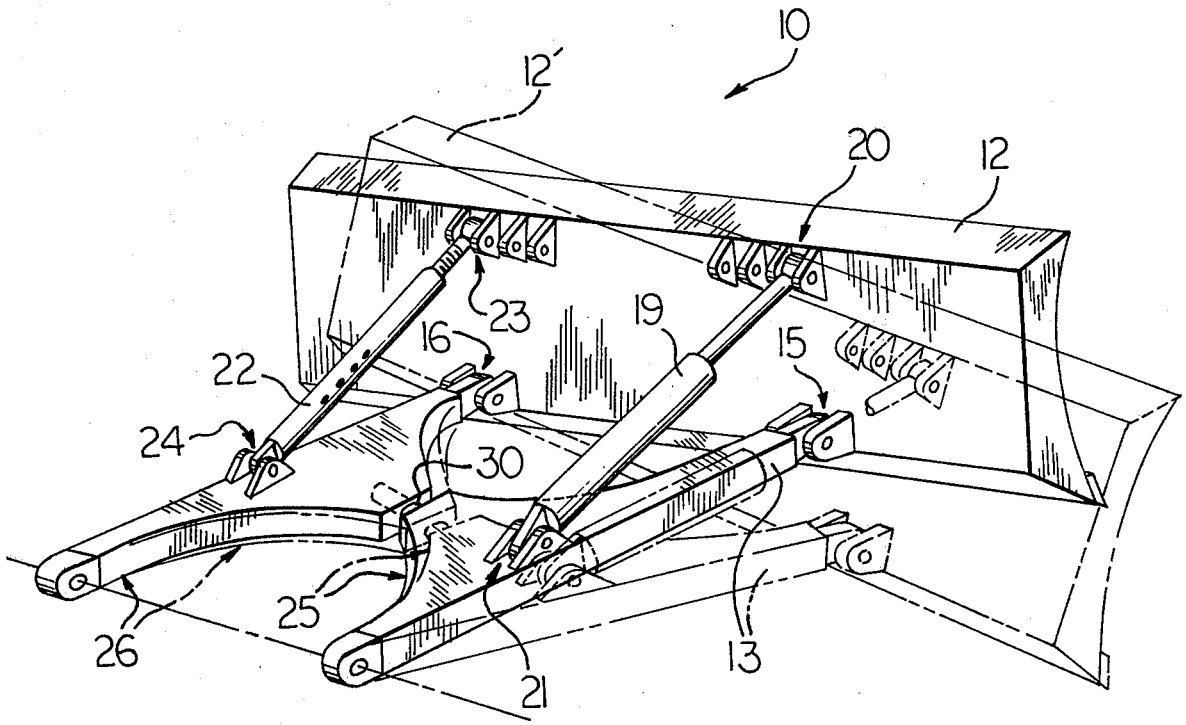
Fig. 3.
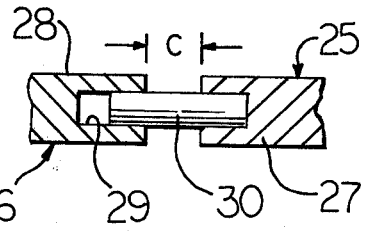
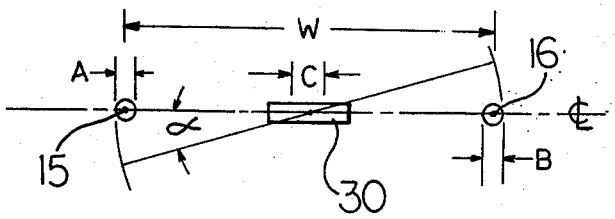
Fig. 5.

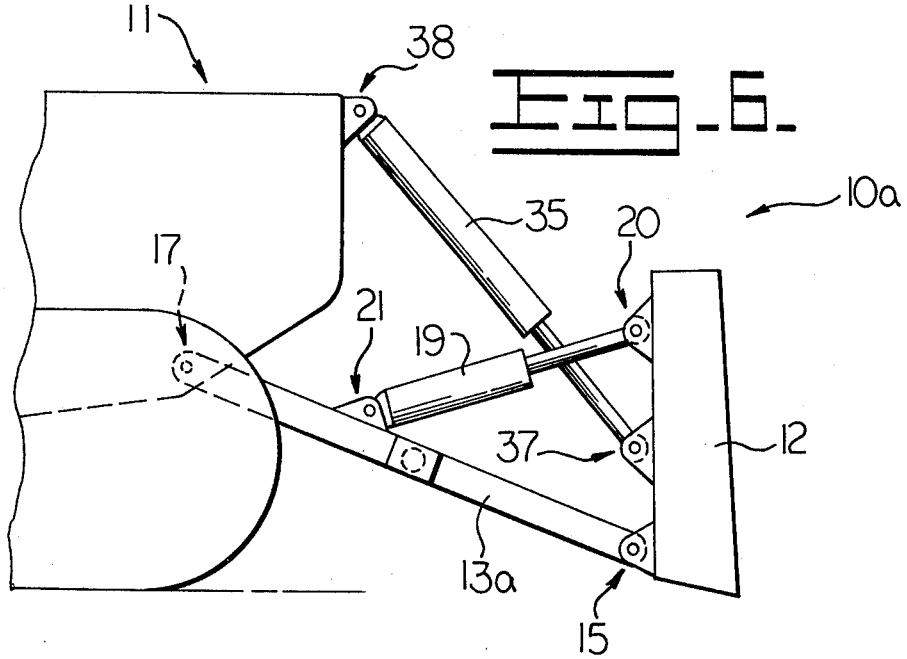
Fig. 6.
Fig. 7.
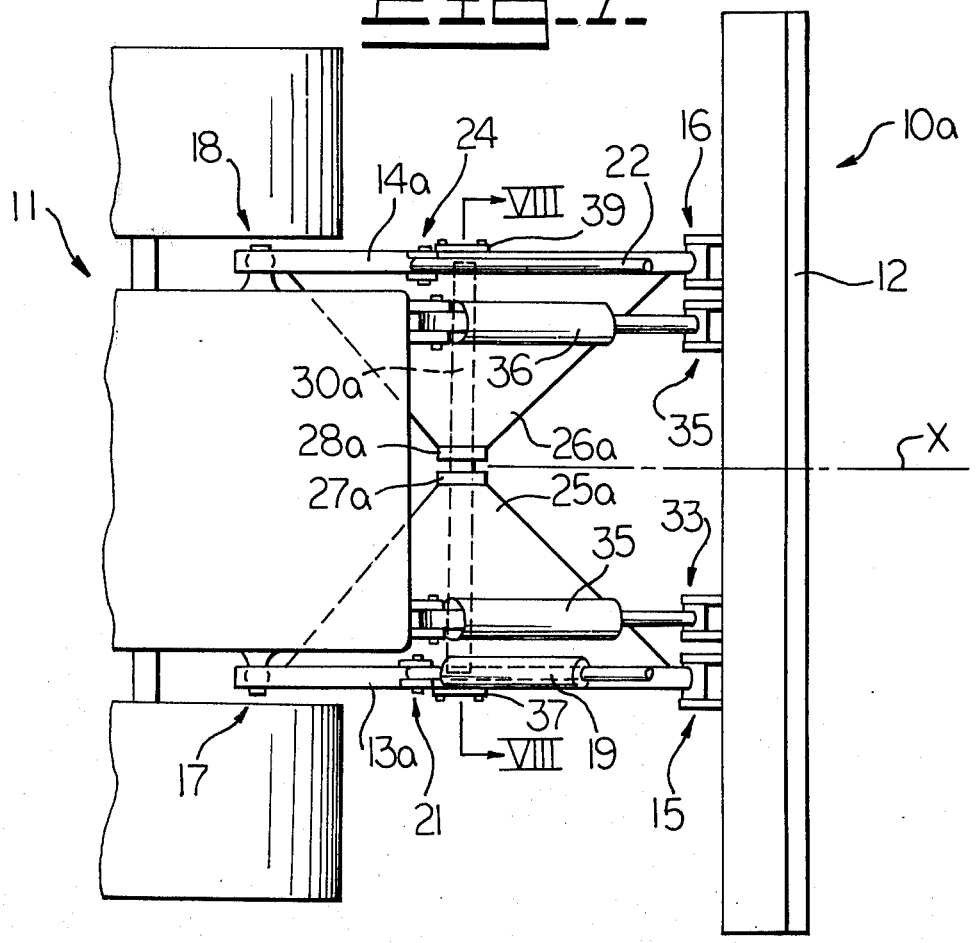

BULLDOZER ASSEMBLY WITH MEANS FOR PIVOTALLY CONNECTING THE PUSH ARMS THEREOF

BACKGROUND OF THE INVENTION

This invention relates to a bulldozer assembly of the types generally shown in U.S. Pat. Nos. 3,049,821 and 3,395,764, both assigned to the assignee of this application. Such bulldozer assemblies normally comprise a pair of laterally spaced push arms pivotally interconnected between the frame of a vehicle and a normally upright blade. Tilting of the blade relative to ground level comprises a brace in the form of a double-acting hydraulic cylinder pivotally interconnected between one of the push arms of the blade. In order to absorb forces imposed on the blade and on the push arms, various types of diagonally disposed stabilizing braces are interconnected between the push arms and blade.

SUMMARY OF THIS INVENTION

An object of this invention is to provide an improved and relatively non-complex and economical bulldozer assembly for alleviating stresses normally imposed thereon during operation thereof. The bulldozer assembly comprises a normally upright blade pivotally connected to the forward ends of a pair of laterally spaced push arms in a stablizing member integrally secured to each of the push arms. The stabilizing members extend inwardly towards each other and are pivotally connected together at a location intermediate the ends of the push arms for permitting relative pivotal and lateral movement therebetween upon tilting of the blade. In a first embodiment of this invention, a pivot pin connecting the inboard ends of the stabilizing members is solely confined therein whereas in a second embodiment thereof the pivot pin extends completely through the members and into the push arms.

BRIEF DESCRIPTION OF THE DRAWINGS

Other objects of this invention will become apparent from the following description and accompanying drawings wherein:

FIG. 3 is a sectional view through a pivot means pivotally interconnecting a pair of stabilizing members employed in the bulldozer assembly and taken in the direction of arrows III—III in FIG. 2;

FIG. 4 is an isometric view of the bulldozer assembly, illustrating it in two tilting positions of operation;

FIG. 5 schematically illustrates movement of the stabilizing members during such tilting; and FIGS. 6–9 are views similar to FIGS. 1–4, respectively, but illustrating a second bulldozer assembly embodiment of this invention and with FIG. 8 being taken in the direction of arrows VIII—VIII in FIG. 7.

DETAILED DESCRIPTION

Figure 1:
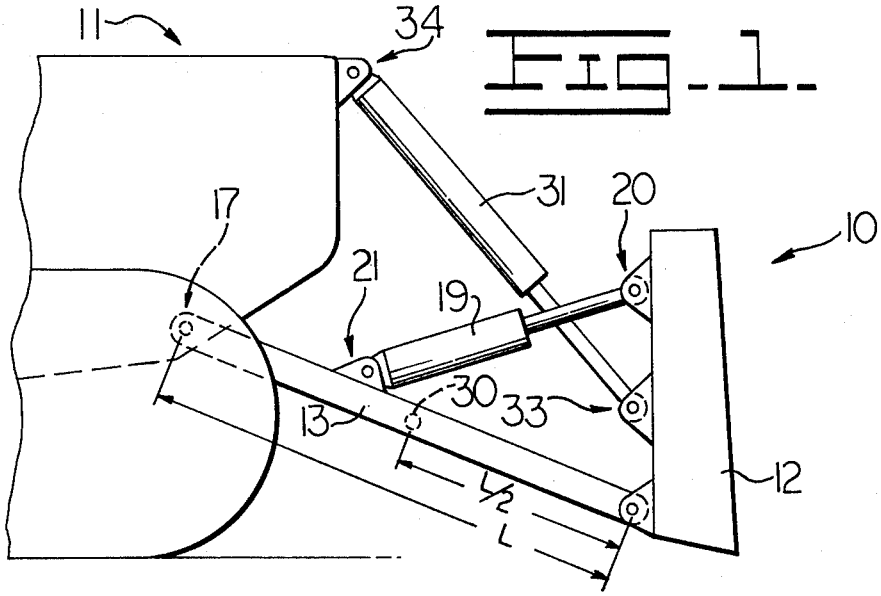
FIG. 1 is a partial side elevational view of a track-type tractor having a first bulldozer assembly embodiment of this invention mounted thereon.
Figure 2:
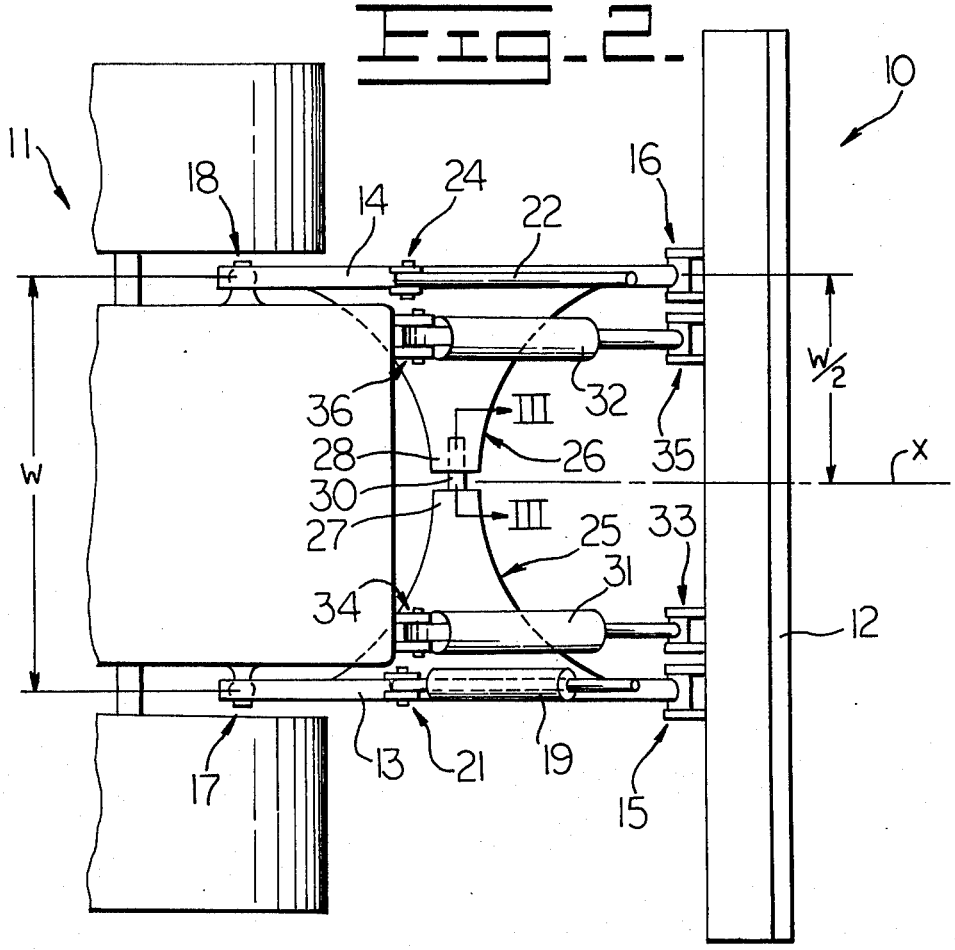
FIG. 2 is a top plan view of the constructions illustrated in FIG. 1.

FIGS. 1 and 2 illustrate a bulldozer assembly 10 of this invention mounted on the forward end of a track-type tractor 11 and disposed on a longitudinal axis X thereof. The bulldozer assembly comprises a normally upright blade 12 disposed transversely relative to such axis and pivotally connected to the forward ends of a pair of laterally spaced push arms 13 and 14 by universal pivot means 15 and 16, respectively. The rearward ends of the respective push arms are pivotally mounted on a frame of vehicle 11 by a second pair of universal pivot means 17 and 18. It should be noted that all the hereindescribed universal pivot means preferably constitute a standard ball and socket type connection.

A first brace 19, preferably constituting a double-acting hydraulic cylinder, is pivotally interconnected between a backside of blade 12 and push arm 13 by universal pivot means 20 and 21. The second brace 22 is pivotally connected to a backside of the blade by universal pivot means 23 (FIG. 4) and to push arm 14 by universal pivot means 24. As will be hereinafter more fully described, selective extension and retraction of tilt brace 19 will function to tilt the blade to various dispositions relative to vehicle 11, as illustrated in FIG. 4.

The first stabilizing member 25 has its outboard end secured to push arm 13 to form an integral part thereof. A second stabilizing member 26 is secured in a like manner at its outboard end base to push arm 14. The stabilizing members extend inwardly towards axis X to have inboard ends 27 and 28 thereof disposed closely adjacent to each other and separated by a clearance C (FIG. 3).

As further shown in FIG. 3, a bore 29 is formed in end 27 of stabilizing member 25 and is disposed in perpendicular relationship relative to axis X (FIG. 2) along with a cylindrical pivot pin 30. A first end of the pin is disposed in tight sliding relationship within the bore whereas the opposite second end thereof may be suitably press-fitted within a bore formed in end 28 of stabilizing member 26 (FIG. 3). Such arrangement thus provides pivot means pivotally mounting the push arms and stabilizing members together for permitting relative pivotal and slight lateral movement therebetween. Alternatively, the pin could also be disposed in tight sliding relationship in member 26.

As shown in FIGS. 1 and 2, the pivot means is preferably disposed intermediate the pivot means at the forward and rearward ends of push arms 13 and 14, at a distance L/2 which is one-half of the length L of each push arm. In addition, the center of the pivot means in a lateral direction is preferably disposed at a distance W/2 which is one-half of the lateral distance between the push arms. As further shown a pair of double-acting hydraulic lift cylinders 31 and 32 are universally interconnected between vehicle 11 and the blade by pivot means 33, 34, 35 and 36 to selectively raise or lower the blade relative to ground level.

In operation, vehicle 11 is normally propelled forwardly in the direction of axis X (FIG. 2) to perform a conventional bulldozing operation. Referring to FIGS. 4 and 5, extension of tilt brace 19 will function to raise the right end of blade 12 to tilt it to its solid line position whereby the pivot means comprising pivot pin 30 will permit the push arms and stabilizing members to pivot relative to each other and will further accommodate a slight lateral sliding movement (narrowing of clearance C) of the members relative to each other. Clearance C is sufficiently large to accommodate the additive inward movements of the push arms (A plus B). Conversely, retraction of the tilt brace will function to raise the left end of the blade to tilt it to its phantom line position 12'.

Referring to FIG. 5, the minimum clearance C may be determined in accordance with the formula C=W (1−cotα) wherein: W equals the lateral distance between the centers of pivot means 15 and 16 and α equals the angle of tilt of pivot pin 30 (one-half the tilt angle of blade 12). Therefore, further assuming a value of 40 in. for W and 3° for angle α, the minimum clearance for C would be 0.0548 in.

FIGS. 6–9 illustrate a second bulldozer assembly embodiment 10*a* of this invention wherein corresponding constructions are depicted by identical number, but with numerals depicting modified constructions in FIGS. 6–9 being accompanied by an *a*.

Bulldozer assembly 10*a* comprises normally upright blade 12 pivotally connected to the forward ends of a pair of laterally spaced push arms 13*a* and 14*a* by universal pivot means 15 and 16, respectively. The rearward ends of the respective push arms are pivotally mounted on a frame of vehicle 11 by a second pair of universal pivot means 17 and 18. A first stabilizing member 25*a* has its outboard end secured to push arm 13*a* to form an integral part thereof whereas a second stabilizing member 26*a* is secured in a like manner to push arm 14*a*.

Figure 9:
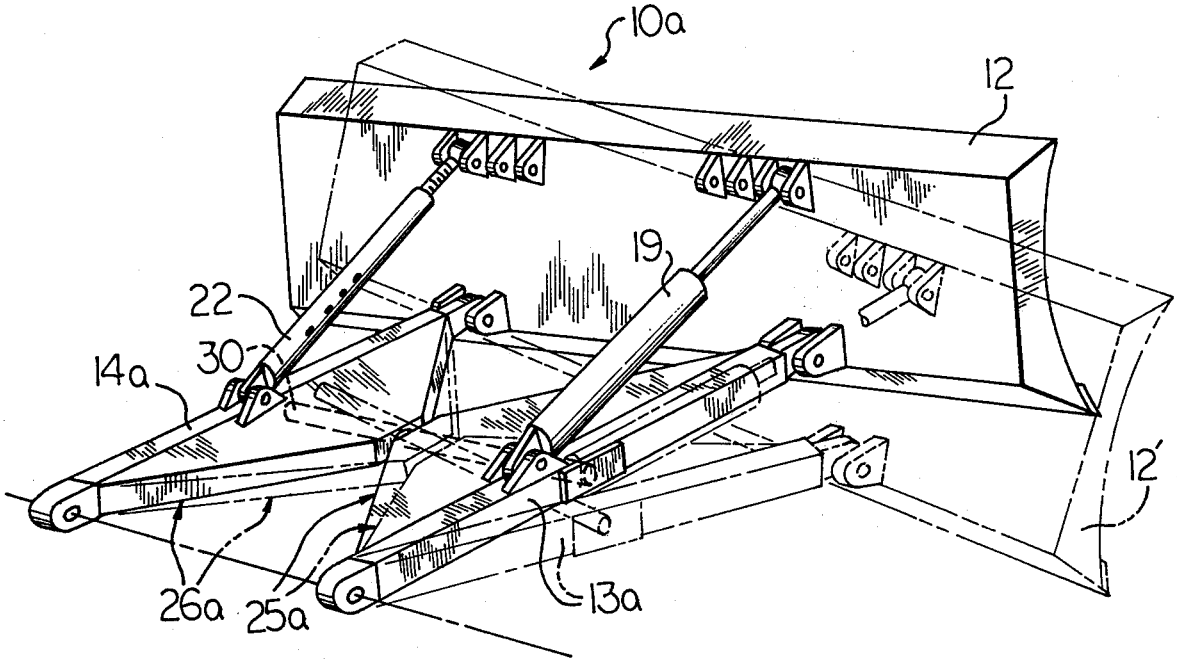
Figure 8:
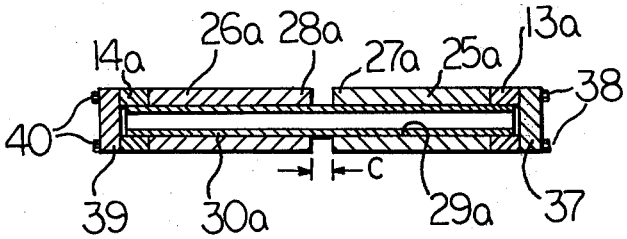

The stabilizing members extend inwardly towards axis X to have inboard ends 27*a* and 28*a* disposed closely adjacent to each other and separated by a clearance C (FIG. 8). As further shown in FIG. 8, a continuous bore 29*a* is formed through push arms 13*a* and 14*a*, stabilizing members 25*a* and 26*a* and is disposed in perpendicular relationship relative to axis X (FIG. 7). The bore mounts a cylindrical pivot pin 30*a* therein in tight sliding relationship to provide pivot means pivotally mounting the push arms and stabilizing members together for permitting relative pivotal movement and slight lateral sliding movement therebetween. The pivot member may be held in position axially by a first stop plate 37 attached to an outboard side of push arm 13*a* by cap screws 38 to cover bore 29*a* and a second stop plate 39 attached to an outboard side of push arm 14*a* by cap screws 40 to cover the bore. As illustrated in FIG. 9, the latter described embodiment will function substantially similar to the afore-described FIGS. 1–5 embodiment.

I claim:

1. A bulldozer assembly disposed on a longitudinal axis thereof comprising a blade normally disposed transversely relative to said axis, a pair of laterally spaced push arms extending in the direction of said axis and each having a forward end thereof pivotally connected to said blade by first pivot means and second pivot means on a rearward end of each push arm adapted to pivotally mount such push arm on a frame of a vehicle, a pair of stabilizing members each having an outboard end thereof integrally secured to a respective one of said push arms and both extending inwardly towards said axis to dispose inboard ends thereof adjacent to each other, and third pivot means disposed perpendicular relative to said axis and further disposed at least substantially midway between the forward and rearward ends of said push arms for pivotally mounting said stabilizing members together for permitting relative pivotal and lateral movement therebetween.

2. The bulldozer assembly of claim 1 wherein said stabilizing members are disposed rearwardly of said blade in disconnected relationship therewith.

3. The bulldozer assembly of claim 1 wherein the forward end of each of said push arms is universally connected to said blade by said first pivot means and the rearward end thereof is universally connected to a frame of a vehicle by said second pivot means and wherein said third pivot means is disposed at least substantially one-half of the distance between the forward and rearward ends of said push arms and is further disposed at least substantially one-half of the lateral distance between the first pivot means universally connecting the forward ends of said push arms to said blades.

4. The bulldozer assembly of claim 2 further comprising a brace pivotally interconnected between said blade and each of said push arms.

5. The bulldozer assembly of claim 3 wherein at least one of said braces comprises a double-acting cyclinder for selectively tilting said blade.

6. The bulldozer assembly of claim 4 further comprising at least one double-acting cylinder pivotally interconnected between said vehicle and said blade.

7. The bulldozer asembly of claim 1 wherein said pivot means constitutes a cylindrical pivot pin having at least a first end thereof slidably mounted in one of said stabilizing members.

8. The bulldozer assembly of claim 7 wherein a second end of said pin is secured to the other one of said stabilizing members.

9. The bulldozer assembly of claim 7 wherein said pivot pin is slidably mounted in a continuous bore formed transversely through said stabilizing members.

10. The bulldozer assembly of claim 9 wherein said bore is further formed transversely through said push arms.

11. The bulldozer assembly of claim 10 further comprising a stop plate attached to an outboard side of each of said push arms to cover said bore.

* * * * *